US007710363B2

(12) United States Patent
Sarrasin

(10) Patent No.: US 7,710,363 B2
(45) Date of Patent: May 4, 2010

(54) CONTROL METHOD FOR A MATRIX DISPLAY SCREEN

(75) Inventor: Denis Sarrasin, Sassenage (FR)

(73) Assignee: Commissariat a L'Energie Atomique, Paris (FR)

( * ) Notice: Subject to any disclaimer, the term of this patent is extended or adjusted under 35 U.S.C. 154(b) by 1078 days.

(21) Appl. No.: 11/312,775

(22) Filed: Dec. 21, 2005

(65) Prior Publication Data

US 2006/0139250 A1 Jun. 29, 2006

(30) Foreign Application Priority Data

Dec. 28, 2004 (FR) ..... 04 13978

(51) Int. Cl.
*G09G 3/20* (2006.01)

(52) U.S. Cl. ..... 345/75.2; 345/55; 345/74.1; 345/75.1

(58) Field of Classification Search ..... 345/55, 345/74.1, 75.1, 75.2; 315/160, 167, 169.1, 315/169.2, 169.3; 313/309, 310, 461, 463
See application file for complete search history.

(56) References Cited

U.S. PATENT DOCUMENTS

| | | | | |
|---|---|---|---|---|
| 5,555,000 | A | 9/1996 | Sarrasin et al. | |
| 5,659,328 | A * | 8/1997 | Todokoro et al. | 345/74.1 |
| 6,215,466 | B1 | 4/2001 | Yamazaki et al. | |
| 6,862,010 | B2 * | 3/2005 | Nicolas et al. | 345/74.1 |
| 2004/0165004 | A1 | 8/2004 | Sagano et al. | |

FOREIGN PATENT DOCUMENTS

| | | | |
|---|---|---|---|
| EP | 0 635 819 | B1 | 1/1995 |
| EP | 1 005 012 | A1 | 5/2000 |
| FR | 2 633 764 | A1 | 1/1990 |
| WO | WO 2004/059606 | A2 | 7/2004 |

OTHER PUBLICATIONS

R. Baptist, "Ecrans fluorescents a micropointes, Microtips fluorescent displays", L'Onde Electrique, vol. 71, No. 6, Nov.-Dec. 1991, pp. 36-42 (with English Abstract).
K. Sakai, et al., "18.3L: Flat Panel Displays Based on Surface-Conduction Electron Emitters", Euro Display, 1996, pp. 569-572.

(Continued)

*Primary Examiner*—My-Chau T Tran
(74) *Attorney, Agent, or Firm*—Oblon, Spivak, McClelland, Maier & Neustadt, L.L.P.

(57) ABSTRACT

A method of controlling display of a grey level at an associated image point on a matrix display screen. The screen includes lines and columns for which the intersections form an image point. Samples with non-linear proportional light intensity are used to display grey levels, instead of using samples with linear proportional light intensity, by selecting a coding that matches the response curve of the human eye because the eye is more sensitive to brightness differences at a low illumination level than at a high level. Its perception of brightness follows a non-linear law called the gamma correction law which in particular has been modelled by the International Lighting Commission (ILC).

10 Claims, 7 Drawing Sheets

OTHER PUBLICATIONS

S. Uemura, et al., "39.3: Carbon Nanotube FED Elements", SID Digest, 1998, pp. 1052-1055.

T. Leroux, et al., "21.1: Microtips Displays Addressing", SID Digest, 1991, pp. 437-439.

Charles Poynton, "The rehabilitation of gamma", Human Vision and Electronic Imaging III, Proceedings of SPIE/IS&T Conference, Jan. 26-30, 1998, pp. 1-18.

Chrysostomos L. Nikias, et al., "Signal Processing with Higher-Order Spectra", IEEE Signal Processing Magazine, Jul. 1993, pp. 10-37.

Jerry M. Mendel, "Tutorial on Higher-Order Statistics (Spectra) in Signal Processing and System Theory: Theoretical Results and Some Applications", Proceedings of the IEEE, vol. 79, No. 3, Mar. 1991, pp. 277-305.

Chrysostomos L. Nikias, et al., "Time Delay Estimation in Unknown Gaussian Spatially Correlated Noise", IEEE Transactions on Acoustics, Speech, and Signal Processing, vol. 36, No. 11, Nov. 1988, pp. 1706-1714.

Hsing-Hsing Chiang, et al., "A New Method for Adaptive Time Delay Estimation for Non-Gaussian Signals", IEEE Transactions on Acoustics, Speech, and Signal Processing, vol. 38, No. 2, Feb. 1990, pp. 209-219.

Ananthram Swami, et al., "Cumulant-Based Approach to the Harmonic Retrieval and Related Problems", IEEE Transactions on Signal Processing, vol. 39, No. 5, May 1991, pp. 1099-1109.

U.S. Appl. No. 12/444,396, filed Apr. 6, 2009, Sarrasin.

* cited by examiner

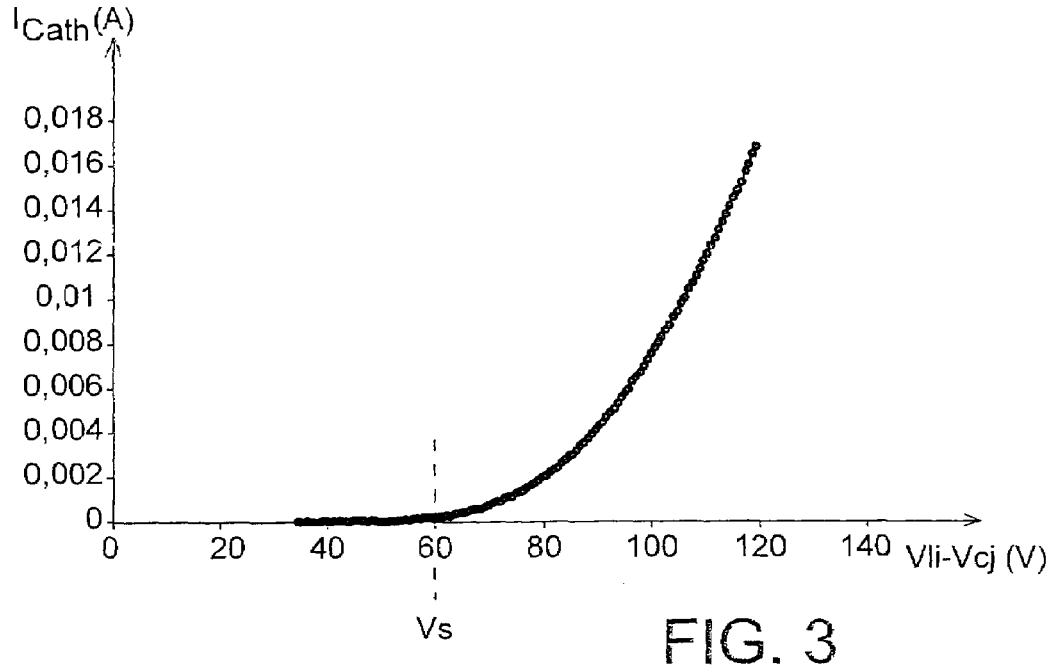
FIG. 3
PRIOR ART
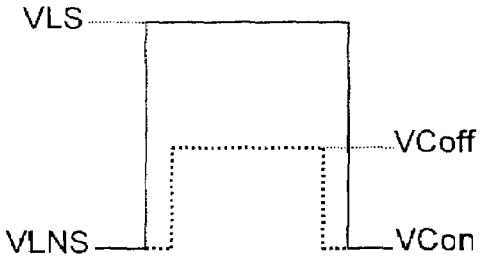
FIG. 4A
PRIOR ART
FIG. 4B
PRIOR ART
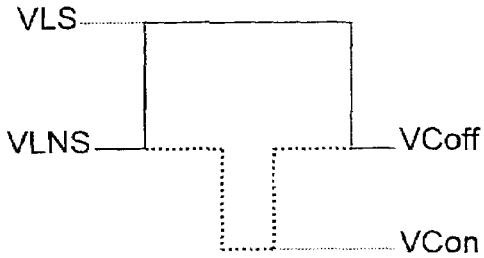

CONTROL METHOD FOR A MATRIX DISPLAY SCREEN

TECHNICAL DOMAIN

This invention relates to a control method for a matrix display screen designed to display images with different grey levels. Images to be displayed may be in black and white or colour, and the expression "grey level" means colour halftone.

STATE OF PRIOR ART

This invention is particularly applicable to matrix displays screens consisting of flat panel displays with electron emission or electron sources.

In particular, it applies to display screens with hot cathodes, photoemissive cathodes and cathodes with field effect microtips as described in document reference [1] at the end of the description, display screens with field effect nanocracks as described in document reference [2], display screens with plane graphite or diamond carbon type electron sources as described in document reference [3].

FIG. 1 diagrammatically illustrates section through a matrix display screen that uses a field emission electron source. This matrix display screen comprises one or several anode electrodes 1, cathode electrodes 2 that are electron sources, grid electrodes 3 isolated from the cathode electrodes 2 but that cooperate with them. Firstly these anode electrodes 1 and secondly the cathode electrodes 2 and the grid electrodes 3 are located on different supports 5, 6 which when they are assembled delimit a space 7 inside which there is vacuum. The cathode electrodes 2 emit an electron flux as a function of the electric field created by the potential difference $V_{GK}$ imposed between the grid electrodes 3 and the cathode electrodes 2.

Bias means apply a voltage $V_G$ to the grid electrodes 3 and a voltage $V_K$ to the cathode electrodes 2. The voltage $V_{GK}$ represents the control voltage that is equal to $(V_G-V_K)$.

A voltage source $V_A$ applies a high voltage to the anode electrodes 1. This voltage (of the order of several hundreds volts) is substantially higher than the voltage applied to the cathode electrodes to attract electrons emitted by the cathode electrodes.

Electrons emitted by cathode electrodes 2 are accelerated and collected by anode electrodes 1to which the high voltage $V_A$ is applied. If a layer of phosphor material 8 is deposited on the anode electrodes 1, the kinetic energy of the electrons is converted to light.

Refer to FIG. 2 that shows a display device with a electron emission matrix display screen and the associated control electronics. In the type of matrix display screen represented, the cathode and grid electrodes extend along approximately perpendicular directions so as to form an electron emitting matrix network. The cathode electrodes generally form the columns and the grid electrodes the lines on the matrix display screen. An image point is at the intersection between a cathode electrode also called the column electrode cl to cm and a grid electrode also called a line electrode l1 to lp. The matrix display screen comprises p lines and m columns. Document reference [4] describes how each image point on the display screen is addressed and therefore how its brightness is controlled.

The device in FIG. 2 comprises a line sweep generator 9. This line sweep generator 9 is connected to a voltage source VLS (for example equal to 80V) and a voltage source VLNS usually connected to the ground. The device also comprises a driving generator 12 to control columns, connected to two voltage sources 13 (for example equal to 40V) and 14 (for example the ground) so as to apply one of these voltages depending on the information to be displayed, to the electrodes in columns cl to cm. Generators 10 and 12 are frequently called <<drivers>>, and are connected to a controller 16 that synchronises the assembly in relation with the data and the supplied control signals.

More specifically, all lines l1, . . . lp are connected to the line sweep generator 9 and each are selected in turn sequentially for a line selection time Tls by applying the voltage VLS that is called the selection voltage. During the line selection time Tls, the voltage of non-selected lines is set to VLNS that is called the non-selection voltage. All columns c1, . . . , cm are connected to the driving generator 12.

During this line selection time Tls, the voltage on columns c1, . . . cm is set to a voltage corresponding to the information to be displayed by the image points located at the intersection of the columns and the selected line. The voltage of non-selected lines VLNS is such that the voltages present on the columns do not affect the display on these lines.

A given grey level on an image point Pi,j located at the intersection of line li and column cj can be obtained by adjusting the value of the potential difference Vli-Vcj applied between the line li and column cj and the duration t during which it is applied, this duration necessarily remaining less than or equal to the line selection time Tls.

FIG. 3 shows that the response curve $I_{cathode}$(Vli-Vcj) of an image point Pi,j comprises an emission threshold Vs. As long as the line/column potential difference remains less than this threshold Vs, there is practically no electron emission.

Therefore, when controlling an image point Pi,j, it is decided to use a modulation of the column voltage Vcj such that when the voltage Vli equal to the non-selection voltage VLNS is applied to line li, the potential difference between VLNS and the column voltage Vcj is always less than the threshold Vs and when the voltage Vli equal to the selection voltage VLS is applied to line li, the column voltage Vcj is such that an area can be reached in which the line/column potential difference vli-Vcj is beyond the threshold Vs.

Lines and columns can be biased in different ways to arrive at the same result since the emission of electrons is controlled by the line/column potential difference Vli-Vcj. FIGS. 4A and 4B show two different constructions that are equivalent at least for the selection time.

In FIG. 4A, the maximum potential difference (and therefore the white) is obtained by applying a column voltage $V_{Con}$ close to VLNS and the minimum potential difference (for the black) is obtained with an intermediate column voltage $V_{Coff}$ between VLNS and VLS.

On the other hand, in FIG. 4B, the minimum potential difference (and therefore the black) is obtained by applying a column voltage $V_{Coff}$close to VLNS and the maximum potential difference is obtained with a column voltage $V_{Con}$ less than VLNS.

In the descriptions given below, the examples will be given depending on the voltage system shown in FIG. 4A. Obviously, the invention is applicable to the two systems.

In the following description, we will consider different column control methods so as to obtain appropriate grey levels.

Analogue modulation of the signal to be applied to the columns is the most obvious solution for displaying grey levels on an electron source display screen. This solution is described in document reference [4], the references of which are given at the end of the description, however it is not very viable in the current state of the art at least for control of complex display screens. A display screen for a 1080p type of high definition television HDTV comprises 1080 lines refreshed at a frequency of 60 Hz and 1920 columns. The line selection time Tls is equal to about 15 μs. If a set up time of about 1% is tolerated, the rise time is about 150 ns, giving a slew rate of 60V/μs for a circuit that should modulate about forty volts. This performance must be achieved at low cost for the 1920 columns with strict constraints on the electrical consumption of these circuits.

The next step was to consider two-level digital addressing with modulation of voltage in time during the line time Tls, called the PWM (Pulse Width Modulation) method. In this addressing method, all columns cl to cn are switched for a variable length fraction of the line selection time Tls at a sufficient potential to extract electrons, and are switched to another potential blocking this extraction during the remainder of this line selection time Tls. This fraction depends on the brightness to be obtained. The displayed grey level is directly proportional to the quantity of charges emitted. Document [5] for which the references are given at the end of the description describes this type of time modulation.

One disadvantage of this addressing type is that frequencies associated with these pulses do not transit in complex display screens without damage. Time constants specific to the display screen depend both on the resistivity of line and column electrodes and the line/column capacitance that has to be charged every time the voltage is modified. The reduction of these values is a strong technological constraint and is difficult to achieve to display a large number of grey levels on large complex display screens. This method also faces the problem of capacitive consumption generated by voltage levels to be switched and the frequency of this switching.

The method described in the patent application number [7] for which complete references are given at the end of the description recommends the use of circuits for switching several voltage levels at moments chosen linearly during the line selection time. The result is that this minimises switching levels to be applied to columns in order to reduce the capacitive consumption, while displaying a large number of grey levels. The brightness response of an electron source display screen is quasi-linear with the excitation time, consequently the method mentioned above is suitable for an electron source coding grey levels linearly.

The methods mentioned above describe solutions based on linear coding of grey levels. Most matrix display screens have response types that respect a linear law, either with respect to a voltage or an excitation time.

Those skilled in the art know that 12 to 14 bits are necessary to transmit a video signal in digital form if samples are used in linear proportion to the light intensity.

European patent application number [6] for which the references are given at the end of the description proposes to make a brightness correction starting from data coded linearly by varying the light emission amplitude during the line selection time, thus assigning different illumination differences to equal set value differences. It also proposes that the same result can be obtained by using a pulse width modulation (PWM) with a non-linear time distribution. This corrects the response for high illumination levels but it does not restore details for low levels.

If we wanted to use a source for which the coding of grey levels is not linear in the document reference [7], the source signal would have to be coded for example using a Look Up Table (LUT) to obtain a numeric code that varies linearly with the light intensity to be transmitted, which must result in coding on at least 12 bits for good reproduction of grey levels.

PRESENTATION OF THE INVENTION

The purpose of the invention is to improve the control method described in document [7] to display a continuum of grey levels in accordance with the response curve of the human eye without a large increase in the number of samples to be processed. A larger number of samples means samples with a shorter duration and therefore faces display screen time constant problems. The method according to the invention is not exclusively applicable to microtip display screens, but to all types of electron emission matrix display screens.

Another purpose of the invention is to make the response of an electron source display screen compatible with non-linear coding, namely gamma correction.

Another purpose of the invention is to reduce the number of bits to be used to control a matrix display screen.

Another purpose of the invention is to propose a control method for a matrix display screen for which capacitive consumption is minimised.

To achieve this, this invention proposes to use samples with non-linear proportional light intensity to display grey levels, instead of using samples with linear proportional light intensity, by selecting a coding that matches the response curve of the human eye because the eye is more sensitive to brightness differences at a low illumination level than at a high level. Its perception of brightness follows a non-linear law called the gamma correction law which in particular has been modelled by the International Lighting Commission (ILC).

More precisely, this invention relates to a method for controlling a matrix display screen with lines and columns for which the intersections form an image point, including application of a line selection voltage to a line during a line selection time and simultaneously a control voltage to a column corresponding to a grey level to be displayed at the associated image point. The grey level is then chosen from among $2^q$ levels and is numerically coded according to a non-linear law in accordance with the perception of brightness by a human eye. The different voltages to be applied to the columns are chosen in a strictly increasing series of $(2^n+1)$ voltages where n is an integer $\geqq 1$, these voltages being distributed in $N=2^n$ pairs of consecutive voltages, each pair being used to display a range of grey levels. The line selection time is subdivided into one or several groups of $2^{(q-n)}$ time intervals where (q-n) integer >1, each group having the same duration. The distribution of these $2^{(q-n)}$ time intervals within a group is made using a non-linear law with a transfer function close to the inverse of that previously used to code the grey levels for the range of corresponding grey levels, for a pair of voltages. For a pair of voltages and a group of time intervals, the voltage applied to a column is either equal to one of the values of the pair of voltages throughout the duration of the group, or is switched from one value in the pair of voltages to the other value at least once during the duration of the group, at the end of a time interval.

The coding law of a grey level G is such that:

$$G=(2^q-1)\times 4.5\times P_G \text{ for } P_G \leqq 0.018$$

and $$G=[(1.099\times P_G)^{0.45}-0.099](2^q 1) \text{ for } P_G>0.018,$$

where $P_G$ is a relative weight (normalised to one) assigned to the grey level.

For a given pair of voltages, a given range of grey levels, a given group of time intervals and a given grey level to be displayed, the voltage of the pair giving the best brightness that can be applied during a given time interval is as follows:

$$\Delta t=\tau(P_G-P_{Ginf})/(P_{Gsup}-P_{Ginf}) \quad (3)$$

where $\tau$ is the duration of a group of $2^{q-n}$ time intervals, $P_G$ is the weight of the grey level to be displayed, $P_{Gsup}$ and $P_{Ginf}$ are the weights of the grey levels corresponding to the upper and lower limits respectively of the range of grey levels associated with the pair of voltages.

When the line selection time is subdivided into two groups of time intervals, the time intervals in the two groups may be distributed symmetrically about the middle of the line selection time so as to limit switching current inrush common to all columns.

It is preferable that the line selection voltage is free of transient during the line selection time.

This invention is particularly applicable to flat panel electron source displays.

This invention also relates to a control device for a matrix display screen according to the method described above that includes:

a numeric data source capable of supplying binary words coded on q bits according to the non-linear law in accordance with the perception of brightness by a human eye and representing codes for the $2^q$ grey levels to be displayed, a screen controller receiving synchronisation signals from the data source and managing signals capable of driving a line sweep generator and a column driving voltage generator that receives codes for grey levels to be displayed for each column, and that generates the voltages in voltage pairs starting from a discrete voltage generator, and switch from one voltage within a pair to the other if necessary.

The binary words are subdivided into two sub-words, one with n bits corresponding to the high order bits and the other with q-n bits corresponding to low order bits. The column driving voltage generator may comprise a combinational logic stage for each column controlling a set of analogue switches to preselect a pair of voltages output by the discrete voltage generator starting from n high order bits of a binary word and a signal output from a counter initialised during each line selection time and to switch from one of the voltages in the pair to the other when the counter has reached the value corresponding to the q-n low order bits of the binary word.

The counter receives a set of non-linearly distributed pulses corresponding to the pair of voltages from a pulse generator connected to the screen controller through a multiplexer that also receives the n high order bits of the binary word output by the data source as an address.

The combinational logic stage may receive the n high order bits of the binary word output by the data source through an offset register associated with memory flip-flops.

The combinational logic stage may be connected to the counter through a comparator that makes a comparison between the signal output from the counter and the q-n low order bits of the binary word output by the data source.

BRIEF DESCRIPTION OF THE DRAWINGS

This invention will be better understood after reading the description of example embodiments given for information only and that are in no way restrictive, with reference to the attached drawings in which:

FIG. 3 shows the shape of the cathode current as a function of the voltage applied to line li and column cj;

FIGS. 4A, 4B illustrate voltages to be applied to a line and a column in two different configurations to control an image point;

Figure 1:
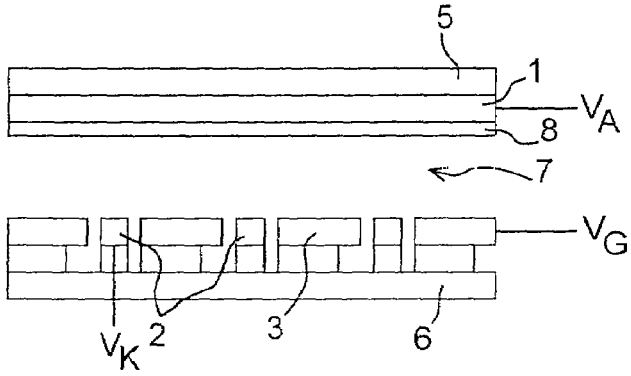
FIG. 1 PRIOR ART
FIG. 1 shows a sectional view of a matrix display screen to which the method according to the invention can be applied.
Figure 2:
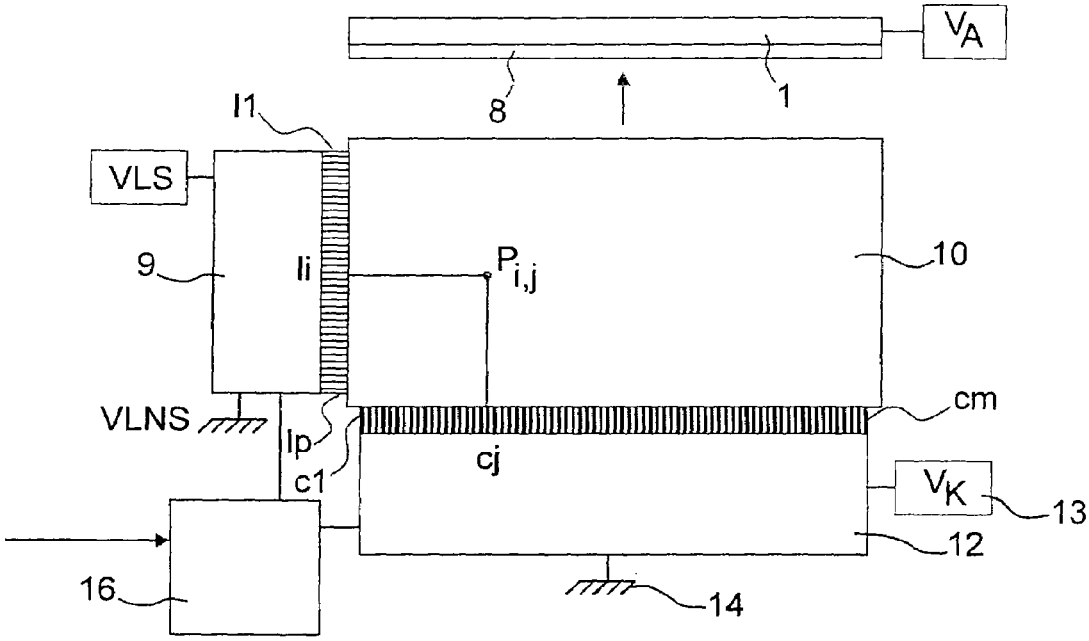
FIG. 2 PRIOR ART
FIG. 2 diagrammatically shows a control device for a known matrix display screen to which the method according to the invention can be applied.

Identical, similar or equivalent parts of the different figures described below are marked with the same numeric references to facilitate understanding of the different figures.

The different parts shown in the figures are not necessarily shown at a uniform scale, to make the figures more easily readable.

DETAILED PRESENTATION OF PARTICULAR EMBODIMENTS

We will now describe an example method according to the invention in more detail.

In this method, an addressing mode is used which includes possibilities of time and voltage modulation due to the electro-optic response of a display screen using an electron source. Beyond the threshold, the brightness obtained varies according to an almost exponential law with the voltage, and linearly with the excitation duration.

The display screen to which the invention is applicable is a matrix display screen with p lines l1 to lp and m columns cl to cm. This matrix display screen is an electron source display screen.

In the method according to the invention, a selected line voltage VLS is applied during the line selection time Tls to a selected line li which in the example described will be a high level because in this example, operation will take place according to the mode in FIG. 4A. During this line selection time Tls, control voltages will be applied to columns cl to cm such that the image point Pi,j at the intersection between the selected line li and the column concerned cj will display a required grey level G. It is decided to use $2^q$ grey levels where q is an integer. The number q corresponds to the number of bits that will be used to code the grey level. Coding on eight bits per colour gives good reproduction of grey levels.

In order to obtain these $2^q$ grey levels, it is chosen to use a set of $2^n+1$ ($n \geqq 1$) successive voltages Vc0 to Vc2$^n$ or VcN if $N=2^n$ to be applied to columns cl to cm of the matrix display screen. This set of voltages to be applied to the columns forms a strictly increasing series. The voltages in the series are grouped into $N=2^n$ voltage pairs, each being formed from two consecutive voltages in the series (Vci, Vci+1). The display at the image point with one of the voltages Vci+1 will be much brighter than the display with the other voltage Vci.

In the increasing series of voltages, the voltages in a pair are such that:

Vci=Vci+1+δvi and the sign of δvi depend on the system of voltages chosen as is explained in FIGS. 4A, 4B. The potential difference between VLS and Vci is less than the potential difference between VLS and Vci+1. voltage gaps δvi may be equal or they may be different as explained in document [7]. Approximately equal voltage gaps are illustrated diagrammatically on the brightness/voltage curve in FIG. 5B.

Therefore, we will thus define $2^n$=N voltage pairs such as (Vc0,Vc1), (Vl1,Vc2) . . . (Vci−1, Vci), . . . (VcN−1,VcN), where VcO represents the voltage for which the potential difference with respect to the line selection voltage VLS corresponds to the electron emission threshold Vs. Application of a voltage of one of the pairs onto a column immediately causes emission of more or less electrons according to the brightness/voltage curve illustrated in FIG. 5B.

The $2^q$ grey levels are distributed into $2^{q-n}$ ranges 90 of q grey levels. One of the ranges π of q grey levels is associated with each pair of voltages Vci, Vci+1.

The line selection time Tls is subdivided into one or several groups T of $2^{(q-n)}$ time intervals [ti+1,ti] between instants t0 and t2$^{q-n}$, where q-n is greater than one. Each group T has the same duration. Time intervals t0 to t2$^{q-n}$ within a group T have different durations for each pair of voltages (Vci, Vci+1). Time intervals t0 to t2$^{q-n}$ in a group T have durations that respect a non-linear law with a transfer function close to the inverse of the transfer function that was used to code the grey levels for the corresponding range π of grey levels.

A given grey level G will be in one of the ranges π of grey levels and this grey level G will be displayed using the pair of voltages (Vci, Vci+1) associated with the said range π of grey levels.

For a given group T of time intervals, either one of the voltages of the pair (Vci, Vci+1), for example Cvi, is applied to a column Ci throughout the duration of the group, or one of the voltages (for example Cvi) is applied initially and then this voltage Vci is switched to the other voltage Vci+1 in the pair at least once at the end of a group time interval T.

The voltage to be applied to a column ci is then equal to the first value Vci during an integer number of time intervals [ti,ti−1] in group T and switches to the second value Vci+1 if necessary, for example during the remainder of the time in the group if a single switching is used.

Time intervals between instants t2$^{q-n}$ and to in the group of time intervals T have durations that vary from one pair of voltages to another according to a non-linear law with a transfer function close to the inverse of the transfer function used to code the grey levels.

The first pair of voltages (Vc0, Vc1) is used to display the range π of the first $2^q/2^n$ grey levels, the second pair of voltages (Vc1, Vc2) is used to display the range π of the next $2^q/2^n$ grey levels, and so on with the pair of voltages (VcN−1, VcN) that is used to display the range π of the last $2^q/2^n$ grey levels.

A grey level G expressed in decimal base may be expressed using a non-linear law in accordance with the perception of brightness by the human eye. This law may be expressed as follows:

$$G=(2^q-1)\times 4.5\times P_G \quad (1)$$

for $P_G \leqq 0.018$ and $$G=[(1.099\times P_G)^{0.45}-0.099](2^q-1) \quad (2)$$

for $P_G>0.018$ where $P_G$ represents the relative weight of the coded grey level normalised to one.

Figure 5A:
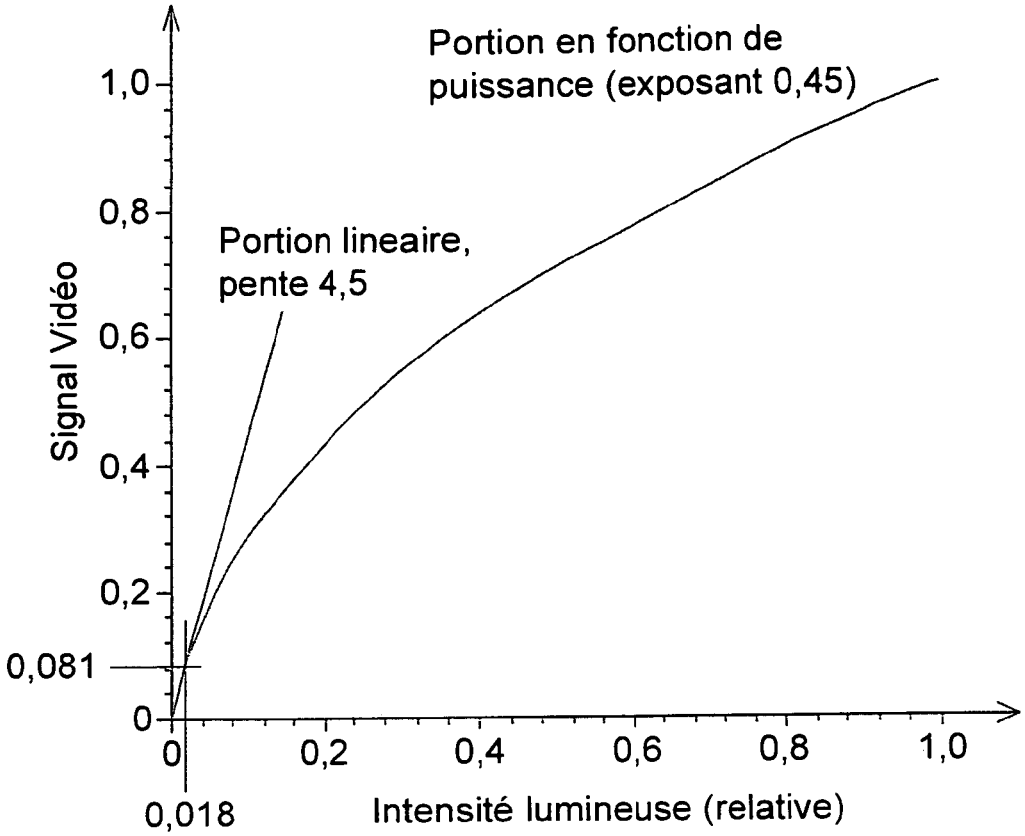
FIG. 5A shows the so-called gamma correction curve that transforms a light intensity or brightness into a video signal and FIG. 5B shows the inverse curve.
Figure 5B:
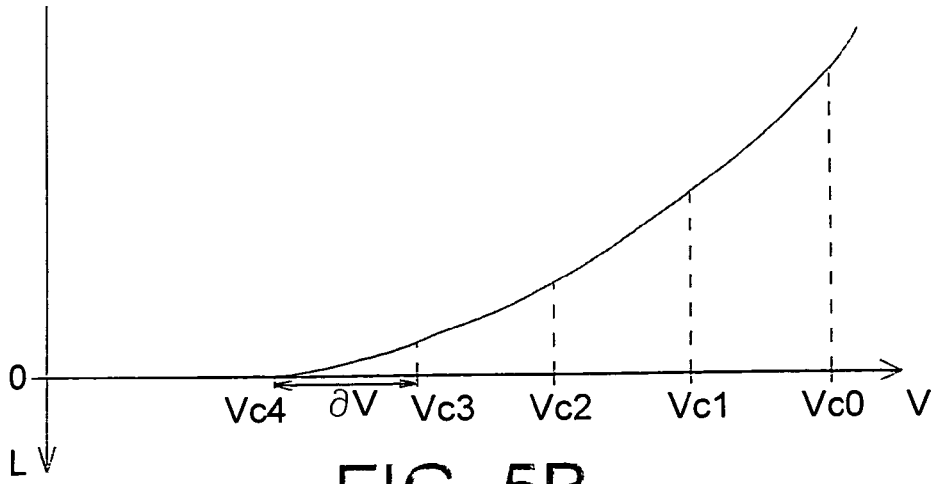

These relations are based on the transfer function of the so-called gamma correction law that transforms a linearly varying light intensity into a non-linear video signal such that the perception of the human eye is as accurate as possible. This non-linear law was modelled and is normalised as described in document [8], the references of which are given at the end of the document. It is shown in FIG. 5A. The substantially linear part corresponds to levels close to black corresponding to 8.1% of the signal corresponding to white and with an intensity less than or equal to 1.8% of the brightness of the white.

Using the code G for the grey level to be displayed, assuming that the voltage is switched once to apply this grey level, the time during which the voltage to display the highest brightness in the pair $V_{ci}$, $V_{ci+1}$ is applied to a column is expressed by:

$$\Delta t=\tau(P_G-P_{Ginf})/(P_{Gsup}-P_{Ginf}) \quad (3)$$

where τ is the duration of a group of $2^{q-n}$ time intervals, $P_G$ is the relative weight of the grey level to be displayed (normalised to one), $P_{Gsup}$ and $P_{Ginf}$ are the grey levels corresponding to the upper and lower limits respectively of the range of grey levels associated with the voltage pair Vci, Vci+1. When there is only one group in the line selection time, τ is equal to Tls. The weight PG is calculated using the inverse of formulas (1) and (2) namely $$P_G=\frac{G}{(2^q-1)\times 4.5} \text{ for } P_G \leq 0.018 \quad (1')$$

and $$P_G=\left[\frac{\frac{G}{2^q-1}+0.099}{1.099}\right]^{1/0.45} \text{ for } P_G>0.018 \quad (2')$$

The weights $P_{Gsup}$ and $P_{Ginf}$ are calculated in the same way starting from grey levels Gsup and Ginf that limit the range of grey levels associated with the pair of voltages. We can write that:

Ginf=G(i×$2^{q-n}$) and Gsup=G((i+1)×$2^{q-n}$) where i is an integer varying from 0 to N−1.

Therefore, this time At is coded according to a non-linear law presenting a transfer function close to the inverse of that shown in (1), (2) used to code the grey levels G for the range π of grey levels considered.

In the example described, it is assumed that the line selection time Tls only comprises a single group of time intervals and that firstly the voltage Vc0 displaying the lowest brightness is applied, followed by switching over to the voltage Vc1 displaying the highest brightness during the remainder of the time in Tls.

The first pair of voltages (Vc0,Vc1) is used to display the ($2^{q-n}$) first grey levels. The application time of the voltage Vc1 enabling emission according to the grey level code G to be displayed must be such that:

$$\Delta t = Tls\times\frac{P_G}{P_{Gsup}}$$

We will now give a first specific example based on the same assumptions.

It is required to display a grey level G=118 on an image point. This grey level is coded on eight bits, namely q=8.

There are $2^8$=256 grey levels. There are $2^n$+1 voltage levels for example n=2 namely 5 voltage levels denoted Vc0, Vc1, Vc2, Vc3, Vc4 forming N=4 pairs (Vc0, Vc1), (Vc1, Vc2), (Vc2, Vc3), (Vc3, Vc4) the rank of which varies from 1 to 4. The line selection time Tls is subdivided into a group T of $2^{q-n}=2^6$=64 time intervals, for which the limits extend between t64 and t0. These time intervals (for example t62-t63) or samples have different durations for each pair of voltages and these durations are calculated according to formula (3). In fact, this formula is used to set the limits of these time intervals relative to the line selection duration Tls.

The binary code corresponding to grey level G=118 in base 10 is:

$$\begin{array}{cc} 01 & 110101 \\ \downarrow & \downarrow \\ n & q-n \end{array}$$

The first n high order bits provide information about the pair of voltages that will be used to control the column that must be addressed to display the grey level G. In our example, the n high order bits are equal to 01. The (Vc1, Vc2) pair with rank 2 that will be used. If these n high order bits had been 00, then the (Vc0, Vc1) pair with rank 1 would have been used. If these n order bits had been 11, then the (Vc2, Vc3) pair with rank 3 would have been used. More generally, the decimal value Y of the n high order bits leads to the use of the pair of voltages with rank Y+1. The (Vc1, Vc2) pair in the example is used to display the range of grey levels for which the limits are 64 and 128.

We will calculate the inverse $P_{118}$ of the code 118 of the grey level considered.

$$P_{118} = \left( \frac{\frac{118}{256-1} + 0.099}{1.099} \right)^{1/0.45} = 0.225.$$

where $P_{118}$ was calculated using formula (2').

The q-n low order bits 110101 correspond to 53 in base 10. They indicate the time at which the switching from voltage Vc1 to voltage Vc2 will take place. It will be at instant t53 that is the upper limit of the time interval [t54, t53].

The time during which the voltage in the determined pair (Vc1, Vc2 ) that displays the highest brightness, namely Vc2, will also be calculated.

$P_{Ginf}=P_{64}=0.0786$ $P_{Gsup}=P_{128}=0.2615$ $P_{64}$ and $P_{128}$ were calculated using formula (2').

$$\Delta t = Tlsx\left( \frac{0.225-0.0786}{0.2615-0.0786} \right) = 0.8xTls$$

The voltage Vc2 will be applied during 80% of the line selection time Tls between instants t53 and to of the line selection duration Tls while the voltage vc1 will only be applied during 20% of the line selection time Tls between instants t64 and t53.

Figure 6A:
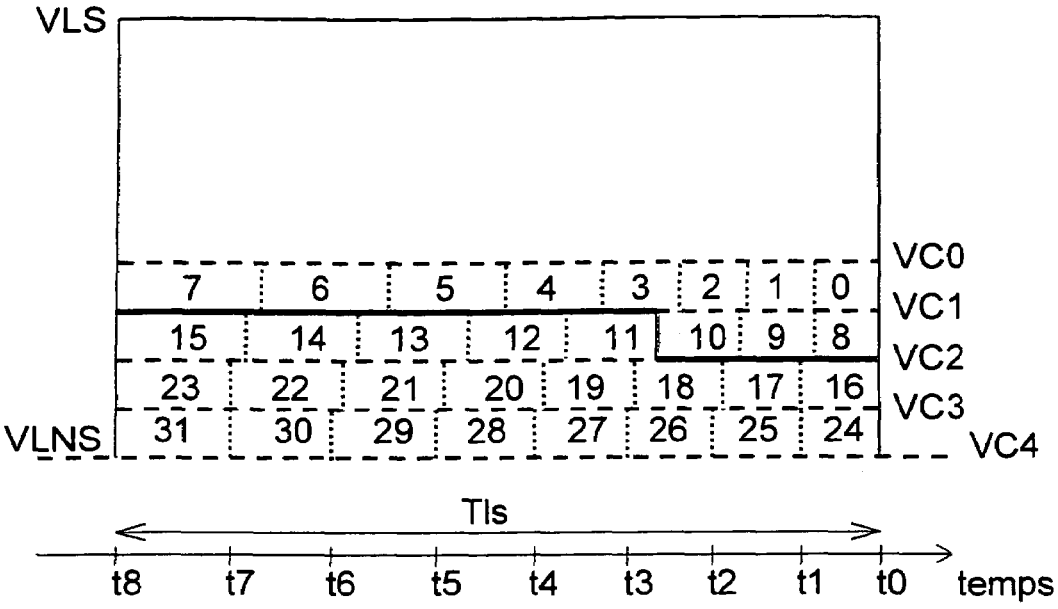
FIGS. 6A, 6B show two examples of signals to be applied to a line and to a column of a matrix display screen to display a given grey level using the method according to the invention.

FIG. 6A also shows a first simplified example of the signal to be applied to a line to select it and the signal to be applied to a column so that the image point at the intersection of the line and the column displays a grey level coded 11 in decimal. During the line selection time Tls between t8 and to, the voltage applied to a selected line changes from VLNS to VLS at the beginning of the time t8 and returns to the VLNS at the end of time t0. It is assumed that q=5 is chosen and that $2^5$=32 grey levels are available.

It is assumed that n=2 and therefore that $2^n$+1=5 voltage values Vc0, Vc1, vc2, Vc3, Vc4 distributed into N=4 pairs (Vc0, Vc1), (Vc1, vc2), (vc2, Vc3), (Vc3, Vc4) are available. These voltages are stored in decreasing order from Vc0 to Vc4 in this example. The voltage Vc0 is such that VLS-Vc0 corresponds to the electron emission threshold of the matrix display screen involved. At voltage Vc0, electrons are emitted but at a very low level that may be insufficient depending on the external ambient brightness in order to have a perception of the associated brightness.

The voltage Vc4 displays the highest brightness.

The binary code of the grey level coded G=11 is:

01 011

The n=2 high order bits 01 provide information about the voltage pair to be used to display this grey level. Therefore the second voltage pair is to be used (Vc1, Vc2 ).

Low order bits 011 provide information about the instant at which switching from one of the voltages Vc1 to the other Vc2 will take place.

The low order bits 011 correspond to 3 in decimal base. During the line selection time Tls, a distinction is made between $2^{q-n}$=8 time intervals bounded by instants t8, t7, t6, t5, t4, t3, t2, tl and t0. For each voltage pair, the instants t7 to t1 are located between t8 and to using the calculations of Δt described above.

In this example, the successive time intervals have decreasing durations but obviously increasing durations would have been possible. As a variant, it would be possible for the distribution of time intervals to correspond to the distribution of the part between t0 and tS in FIG. 6B, except that the time interval [t8, t0] would be equal to the line selection time Tls and not half of it.

Returning to the example illustrated in FIG. 6A, it has been seen that the low order bits 011 represent 3 in base ten, which implies that switching from voltage Vc1 to Vc2 will take place at instant t3, at the end of the time interval bounded between t4 and t3.

Figure 6B:
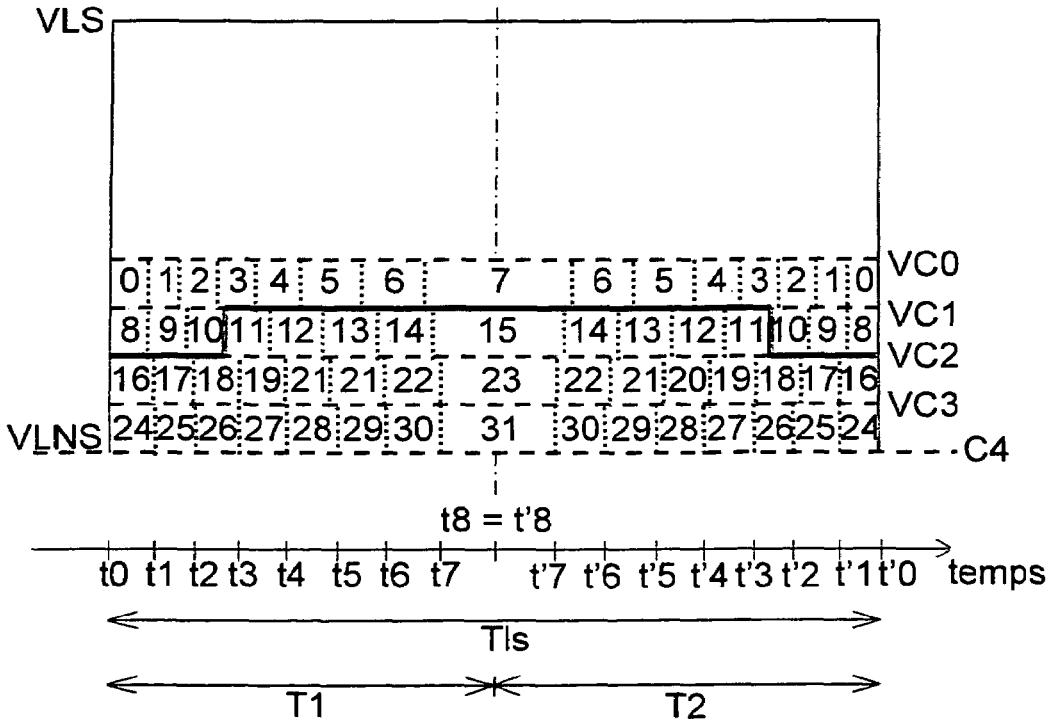

In the other example derived from FIG. 6B, switching from voltage Vc2 to voltage Vc1 would take place at instant t3, at the end of the time interval bounded between t2 and t3.

Figure 8A:
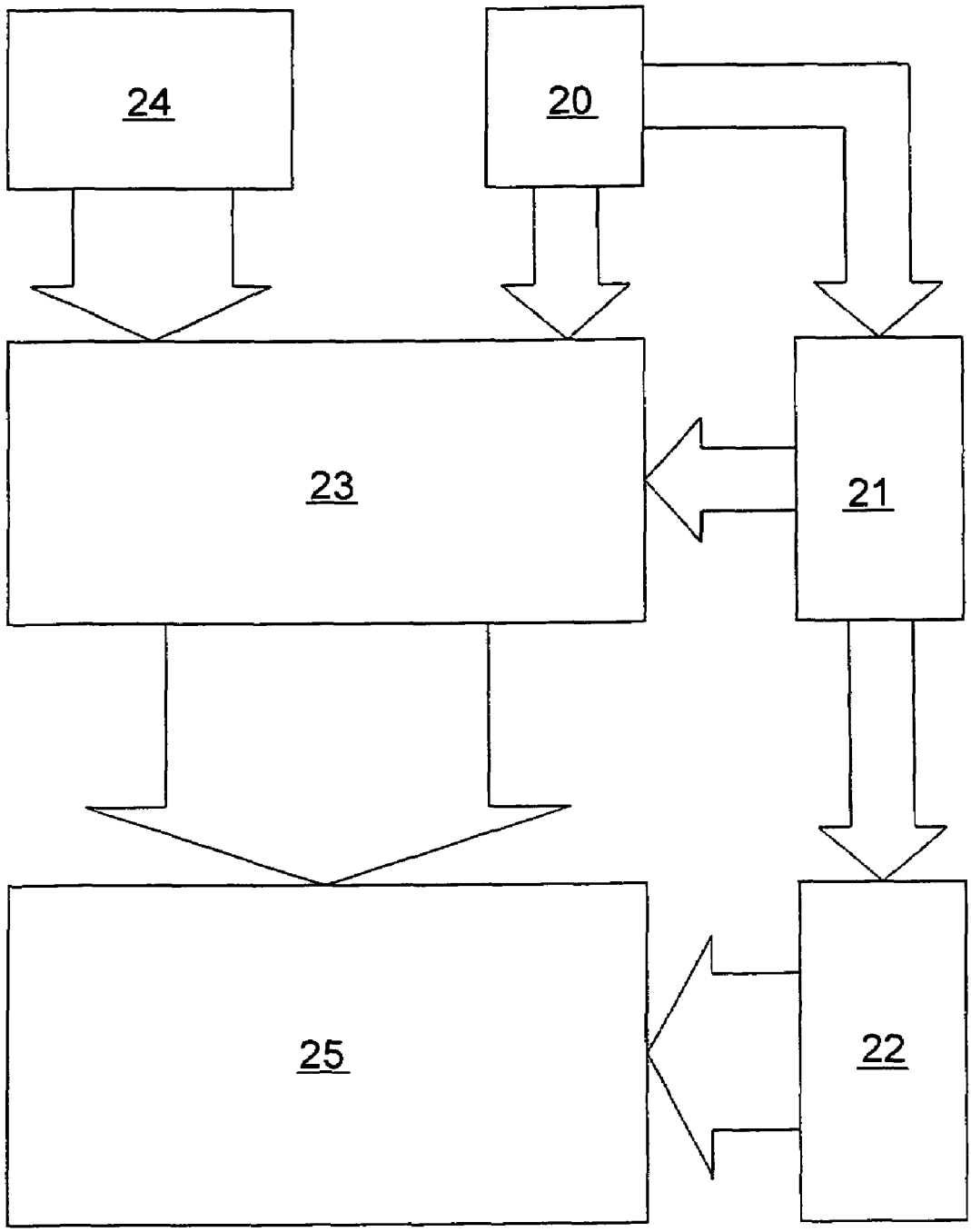
FIGS. 8A, 8B illustrate general and detailed views of a control device for a matrix display screen using the method according to the invention.
Figure 8B:
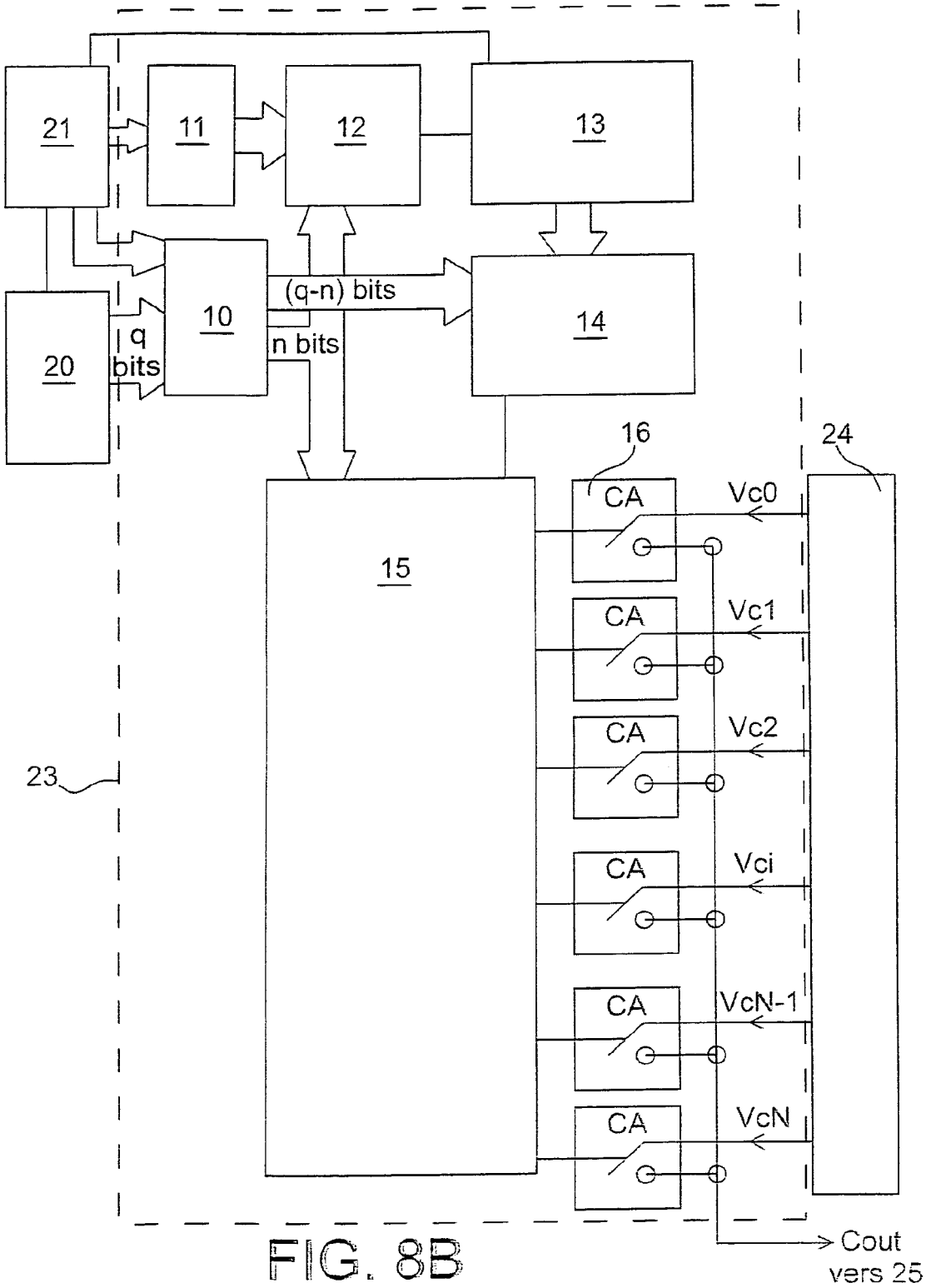

The different possible switching times from one voltage to the other may be drived by pulse signals output from a screen controller 21 for example in response to a look up table 11 like that illustrated in FIG. 8B. These pulses may be used by counting means 13 which will determine the instant or instants at which switching must take place, depending on the low order bits of the grey levels to be displayed and therefore the appropriate voltage pair. A specific signal will be associated with each voltage pair, carrying all possible switching instants only one or some of these instants will be activated depending on the grey level to be displayed, and the others will be neutralised.

The grid shown in dashed lines represents the different possible switching instants for each voltage pair and the number entered in each box represents the grey level obtained expressed in decimal base, if switching in a pair of voltages occurs from the voltage displaying the lowest brightness to the voltage displaying the highest brightness.

The bold line shows the shape of the signal to be applied to a column to obtain the grey level coded 11 on an image point located at the intersection of this column and a selected line. The boxes marked with numbers 0, 8, 16, 24, in other words in the form $2^k$, represent grey levels obtained without switching. To obtain the grey level 0, the voltage applied is equal to Vc0 throughout the line selection time Tls, for the grey level 8 the voltage applied stay at Vc1 and so on.

Obviously, it is possible to apply several groups of time intervals in the line selection time Tls. FIG. 6B illustrates one advantageous variant of how the invention is used in which the line selection time Tls is subdivided into two equal groups T1, T2 of $2^{q-n}$ time intervals. The distribution of the $2^{q-n}$ time intervals in these two groups is symmetric about the middle of the line section time Tls. The first group T1 is bounded by instants t0 to t8 and the second group is bounded by instants t8' (=t8) and t0'.

To display the grey level coded 11, the pair of voltages (Vc1, Vc2 ) will be used as described above. During the first group T1 of time intervals, voltage Vc2 is applied from instant t0 to instant t3, and the voltage is then switched over to Vc1. Voltage Vc1 is applied from instant t3 to instant t8. During the second time interval T2, voltage Vc1 is applied from instant t8' to instant t3', the voltage is then switched to Vc2. The voltage Vc2 is applied from instant t3' to instant t0'. The signal applied to the columns is symmetric about instant t8 or t8', since these two instants are coincident.

In FIGS. 6A and 6B, the referenced instants correspond to the instants of the voltage pair Vc3, Vc4.

This variant provides a rise and fall times distribution that avoids switching current inrushes common to all columns.

To eliminate the inevitable distortions due to rise and fall times of signals to be applied to the lines in the display screen, the line section time Tls used for controlling signals on the columns corresponds to the duration during which the line section signal is well set up, in other words has reached its VLS level and consequently, the end dead times tm corresponding to the rising and falling fronts of the signal will be ignored when changing from the non-selection level VLNS to the selection level VLS, and vice-versa. The line selection time then does not contain any end dead times and therefore voltage transients.

Figure 7:
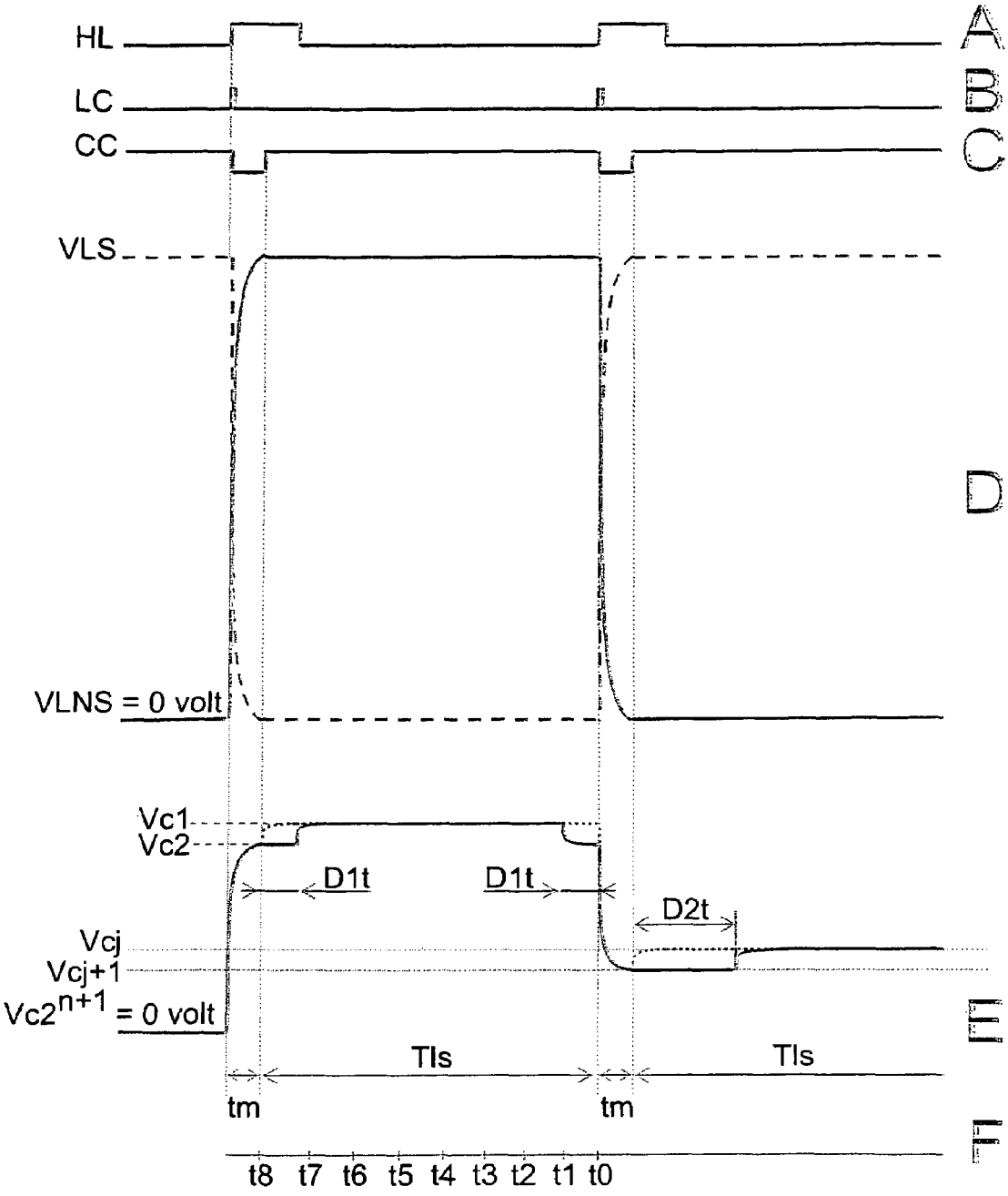
FIG. 7 illustrates the signals used to control a matrix display screen in the example of FIG. 6B taking account of dead times, in the form of time diagrams (7A to 7F)

FIG. 7 illustrates signals used to control a matrix display screen in the example shown in FIG. 6B taking account of dead times, in the form of time diagrams (7A to 7F).

Time diagram 7A is a line clock signal HL for which the rising front will trigger a signal transition to be applied to the lines: changeover from VLNS to VLS or vice versa.

The signal to be applied on the lines is illustrated by the time diagram 7D. It is generated by the line sweep generator. Solid lines show the signal to be applied to a selected line and the signals in dashed lines illustrate the signals that were applied to the previous line and that will be applied to the next line.

Time diagram 7B illustrates a pulse signal LC that controls loading of data related to columns to be controlled. For each pulse rising front, the columns control voltage generator switches the column for a given image point from the voltage that it had at the previous line selection time to the voltage that it must take on at the beginning of the current line selection time.

Time diagram 7C illustrates the signal CC that will enable the signal to be applied to the columns to be independent of end dead times tm. The positive part of this signal corresponds to the time Tls used to code the grey levels. The signal is applied to the pulse generator 11 (described later in FIGS. 8) to validate the useful time in the series of pulses as illustrated in time diagram 7F.

Time diagram 7E shows the shape of the signal to be applied to a column to display the grey level represented in FIG. 6B. At the beginning of the line selection time excluding the end dead time tm, the voltage applied to the column is Vc2, this voltage on the column is maintained for a duration D1t and then switches to voltage Vc1, it maintains this voltage and then switches to voltage Vc2 with an advance of D1t from the end of the line selection time Tls excluding the end dead time tm.

The voltage applied to this same column will then be used to control an image point at the intersection between this column and the next line that is now selected. Once the end dead time tm has elapsed, a voltage Vcj+1 is applied to it for a duration D2t and the voltage is then switched to Vcj, this voltage Vcj is maintained and the voltage is then switched to Vcj+1 with an advance of D2t from the line selection time Tls excluding the end dead time tm.

Time diagram 7F illustrates a series of pulses taken from among the $2^n$ series associated with each pair of voltages (Vci, Vci+1). The pulses are produced by a pulse generator 11 to generate the changeover between two voltages through a multiplexer 12, a counter 13 and a comparator 14 subsequently described in FIG. 8B.

We will now consider a control device for a matrix display screen 25 used to display grey levels, with reference to FIGS. 8A, 8B. The display screen 25 comprises lines li and columns cj that intersect and for which the intersections form the image points Pi,j.

The control device comprises a line sweep generator 22 and a column driving voltage generator 23. The column driving voltage generator 23 is connected to a numeric data source 20 that can supply binary words representing codes for $2^q$ grey levels to be displayed, to a screen controller 21 and to a generator of $2^n$+1 (or N+1) discrete voltages 24. These binary words are coded on q bits following the response curve of the human eye. The screen controller 21 is also connected to the line sweep device 22 (not shown in FIG. 8B). The screen controller 21 receives synchronisation signals from the data source 20, it manages and outputs signals capable of driving the line sweep generator 22 and the column control voltage generator 23.

The binary words supplied by the data source 20 have q bits, and are broken down into two sub-words, one of which is formed from n high order bits and the other is formed from q-n low order bits. The sub-word formed from the n bits is used to determine the voltage pair to be used depending o the grey level to be displayed. The sub-word formed from the q-n low order bits translates a switching time from one voltage in the pair to the other.

The column driving voltage generator 23 comprises one output for each column. Each output Cout from the column driving voltage generator 23 is drived by a control circuit 16 comprising N+1 analogue switches CA in which all outputs are connected to the column of the channel considered, the validation inputs of these switches CA being controlled by a combinational logic stage 15 firstly receiving the sub-word formed from the n high order bits representing the grey level to be displayed, and secondly a signal output from a counter 13 initialised during each line time Tls and supplying the index of the addressing sequence within the line selection time Tls. This counter 13 itself receives a set of $2^{q-n}$ pulses per line time Tls, this set of non-linearly distributed pulses being chosen from among $2^n$ set according to the n high order bits of the grey level to be displayed. The set of pulses are supplied for example using a look up table (LUT) type circuit associated with a counter that is reset to zero at the beginning of each line selection time Tls. The times At between the beginning of the line selection time and each of the pulses supplied are in accordance with the times expressed by formulas (1), (2), (3). The combinational logic stage 15 selects a pair of voltages from the n high order bits and then switches over from voltage Vci to Vci+1 when the counter 13 reaches the value corresponding to q-n low order bits in the binary word corresponding to the grey level to be displayed.

More precisely, as shown in FIG. 8B, the screen controller 21 outputs the control signals LC (time diagram 7B) and CC (time diagram 7C) in FIG. 7, to the pulse generator 11. The numeric data source 20 outputs data words coded on q bits according to the human eye response source, and the necessary synchronisation signals. Data are received conventionally by a device 10 including an offset register for each column associated with memory flip-flops for each of the different channels to be controlled. Furthermore, each output Cout from the column driving voltage generator 23 must be capable of switching between two voltages supplied by the generator of N+1 discrete voltages 24.

The pulse generator 11 produces sets of non-linearly distributed pulses on its $2^n$ outputs corresponding to instants t0 to $t2^{q-n}$ (time diagram 7F) for each pair of voltages (Vci, Vci+1) respectively. Its output is connected to the multiplexer 12 that also receives an address in the n high order bits of the q-bit binary word representing the grey level to be displayed output by the data source 20. The multiplexer 12 switches the set of pulses corresponding to the pair of voltages determined by the n high order bits, to the counter 13. The output from the multiplexer 12 acts as a clock for counter 13 that is reset to zero at the beginning of the line selection time by the screen controller 21. The output from the (q-n)-bits counter 13 is connected to a comparator 14 that makes a comparison between the (q-n) -bits word output by the counter 13 and the q-n low order bits in the binary word output by the data source 20. The output from the comparator 14 changes state when the value counted by the counter 13 becomes equal to or greater than the value output from the data source 20. The output from the comparator 14 is sent to the combinational logic stage 15, into which the n high order bits are also input, to drive the changeover from voltage Vci (selected by the high order bits) to voltage Vc+1. This change is achieved because the control circuit 16 contains analogue switches CA for which the outputs form an output Cout from the column driving voltage generator 23, this output being connected to a column in the display screen 25, only one of the switches CA being closed at any one time.

One advantage of the method according to the invention over conventional methods using time modulation of the voltage is that the columns receive less information to be managed for the same image quality, and another advantage is that the use of time is optimised. For example, in a system with two voltage levels (classical PWM), at least 12 bits are necessary to transcribe a digital video image with 1080p HDTV quality, for a line time of about 15 μs. A linear time division gives a sampling time of $15/2^{12}$# 3.7 ns. The change to 8 bits increases this time by a factor of 16.

More precisely, in the voltage system shown in FIG. 4A, the white corresponding to level 255 for coding on 8 bits is obtained on the image point considered during the line selection time Tls, by applying the voltage VLS on the line and the minimum voltage, for example VLNS=0 Volt on the column. As a first approximation, the grey level 254 can then be obtained by reducing the column excitation time by:

$$\Psi = Tls\left[1 - \left(\frac{G}{255}\right)^{\gamma}\right]$$

where G=254, where G is the code of the grey level to be displayed and γ is equal to approximately 2.5. For a line selection time Tls equal to 15 μs, Ψ is equal to about 150 ns. All other grey levels G (varying from 0 to 254) are obtained with longer durations because levels with lower ranks are obtained by extending this reduction of the excitation time. The choice of G equal to 255 gives T=0 and the voltage VcN+1 is maintained throughout the line selection time Tls. Therefore in the method according to the invention, the shortest pulse duration is 40 times longer than the pulse duration to be applied using a linear method.

In summary, the method according to the invention can increase the duration between switching while reducing the capacitive consumption by minimising voltage transitions applied to columns during the changeover from one addressed line to the next. Depending on the grey level to be displayed, switching in a voltage pair is planned at times distributed over well defined non-linear scales. Low order bits of the grey level will control the time response for the selected level, while high order bits will be used to choose the voltage pairs. Voltage values will be predefined so as to obtain a uniform brightness response from one voltage to the next in the sequence. Since the voltage response of an electron source is close to the inverse of the gamma correction transfer function, voltages can be staged with successive differences relatively close to each other.

The method according to the invention is not limited to display screens for displaying video type images, it may also be applied to control of a display screen not displaying any video signals such as personnel computer display screens. In this case, there are linearly coded signals available to be applied to columns. Codes corresponding to the gamma correction can be extracted using a look up table LUT so as to distinctly display all grey levels while reducing the number of samples (and therefore with longer sample times).

Although several embodiments of this invention have been represented and described in detail, it will be understood that various changes and modifications can be made without going outside the scope of the invention.

DOCUMENTS MENTIONED

[1] "Ecrans fluorescents to micropointes" by R. Baptist (L'onde electrique, November-December 1991, volume 71, n° 6, pages 36-42).

[2] "Flat panel displays based on surface conduction electron emitters" by K. Sakai and al. (Proceedings of the 16$^{th}$ international display research conference, ref.18.3L., pages 569-572).

[3] "Carbon nanotubes FED elements" de S. Uemura and al. (SID 1998 Digest, pages 1052-1055).

[4] "Microtips display addressing" by T. Leroux and al. (SID 91 Digest, pages 437-439).

[5] FR-A-2 633 764.

[6] EP-A-1 005 012.

[7] EP-A-0 635 819.

[8] Recommendation ITU-R BT.709, Basic Parameter Values for the HDTV Standard for the Studio and for International Programme Exchange (1990) [formerly CCIR Rec. 709]. (Geneva: ITU,1990).

[9] "The rehabilitation of gamma" by Charles Poynton. (Human Vision and Electronic Imaging III, Proceedings of SPIE/IS&T Conference 3299, San Jose, Calif., Jan. 26-30, 1998 (Bellingham, Wash.: SPIE, 1998)).

The invention claimed is:

1. A method for controlling a matrix display screen with lines (li) and columns (cj), an intersection between a line and a column forming an image point (Pi,j), said image point being able to display a grey level chosen from among $2^q$ grey levels, said $2^q$ grey levels being numerically coded according to a non-linear relationship in accordance with a brightness perception of a human eye, the method comprising:

applying a line selection voltage (VLS) to a line corresponding to said image point during a line selection time (Tls). and simultaneously applying a voltage signal corresponding to a given grey level (G) to a column corresponding to said image point, said line selection voltage and voltage signal enabling said image point to display said given grey level, wherein said applying includes, selecting from among different pairs of voltages (Vci, Vci+1) corresponding to said voltage signal applied to the column, said different pairs of voltages being a strictly increasing series of $(2^n+1)$ voltages where n is an integer $\geqq 1$, these voltages being distributed in $N=2^n$ pairs of consecutive voltages, each pair usable to display a range of grey levels, subdividing the line selection time (Tls) into one or several groups of $2^{(q-n)}$ time intervals where (q-n) is an integer >1, each group having a same duration, distributing these $2^{(q-n)}$ time intervals into a group for a pair of voltages, corresponding to the voltage signal selected in the selecting, according to the non-linear relationship, and applying the voltage signal to said column includes applying one of the pair of voltages selected in the selecting throughout a duration of the group, or switching from one value of the pair of voltages selected in the selecting to the other, at least once during the duration of the group at an end of a time interval.

2. The method according to claim 1, wherein the non-linear relationship is:

$$G=(2^q-1)\times 4.5\times P_G$$

for $P_G \geqq 0.018$ and $$G=[(1.099\times P_G)^{0.45}-0.099](2^q-1)$$

for $P_G>0.018$, where $P_G$ is a relative weight assigned to the given grey level G.

3. The method according to claim 2, wherein for a given pair of voltages, a given range of grey levels, a given group of time intervals and a given grey level to be displayed, the method further comprising applying the given pair of voltages, which lead to a highest brightness, for a time interval given by:

$\Delta t=\tau(P_G-P_{Ginf})/(P_{Gsup}-P_{Ginf})$ where $\tau$ is a duration of a group of $2^{q-n}$ time intervals, $P_G$ is a weight of the grey level to be displayed, and $P_{Gsup}$ and $P_{Ginf}$ are weights of grey levels corresponding to upper and lower limits respectively of a range of grey levels associated with the given pair of voltages.

4. The method according to claim 1, wherein the subdividing the line selection time includes subdividing the line selection time into two groups of time intervals, the time intervals in the two groups are distributed symmetrically about a middle of the line selection time.

5. The method according to claim 1, wherein the applying includes applying the line selection voltage free of voltage transients during the line selection time.

6. The method according to claim 1, wherein the matrix display screen is a flat panel with electron source.

7. A control device for a matrix display screen with lines (li) and columns (cj), an intersection between a line and a column forming an image point (Pi,j), said image point being able to display a grey level chosen from among $2^q$ grey levels, said $2^q$ grey levels being numerically coded according to a non-linear relationship in accordance with a brightness perception of a human eye, said control device comprising:

a numeric data source which supplies binary words coded on q bits according to the non-linear relationship in accordance with the brightness perception by the human eye and representing codes for $2^q$ grey levels to be displayed;

a screen controller which receives synchronisation signals from the numeric data source and manages signals that drive a line sweep generator and a column driving voltage generator that receives codes of the grey levels to be displayed for each column;

a discrete voltage generator which generates different pairs of voltages (Vci, Vci+1) to be applied to the column, said different pairs of voltages being a strictly increasing series of $(2^{n+}1)$ voltages where n is an integer $\geqq 1$, these voltages being distributed in $N=2^n$ pairs of consecutive voltages, each pair usable to display a range of grey levels, wherein the screen controller subdivides the binary words into two sub-words, one with n bits corresponding to high order bits and other with q-n bits corresponding to low order bits, the column driving voltage generator includes a combinational logic stage that controls a set of switches to select a pair of voltages output by the discrete voltage generator from the n high order bits of a binary word and a signal output by a counter initialised at each line selection time, said combinational logic stage also switching from one of the voltages in the pair of voltages selected by the combinational logic stage to the other when the counter has reached a value corresponding to the q-n low order bits of the binary word, where (q-n) is an integer >1; and a multiplexer, wherein the counter receives a set of non-linearly distributed pulses, corresponding to the pair of voltages, output from a pulse generator connected to the screen controller through the multiplexer, the multiplexer also receiving the n high order bits of the binary word output by the numeric data source as an address.

8. The control device according to claim 7, wherein the combinational logic stage receives the n high order bits of the binary word output by the data source through an offset register associated with memory flip-flops.

9. The control device according to claim 7, wherein the combinational logic stage is connected to the counter through a comparator that makes a comparison between the signal output from the counter and the q-n low order bits of the binary word output by the numeric data source.

10. A control method executed by a controller apparatus for a matrix display screen with lines (li) and columns (cj), an intersection between a line and a column forming an image point (Pi,j), said image point being able to display a grey level chosen from among $2^q$ grey levels, said $2^q$ grey levels being numerically coded according to a non-linear relationship in accordance with a brightness perception of a human eye, said method comprising:

supplying, at a numeric data source, binary words coded on q bits according to the non-linear relationship in accordance with the brightness perception by the human eye and representing codes for $2^q$ grey levels to be displayed, receiving, at a screen controller, synchronisation signals from the numeric data source and managing signals that drive a line sweep generator and a column driving voltage generator that receives codes of the grey levels to be displayed for each column, generating, at a discrete voltage generator, different pairs of voltages (Vci, Vci+1) to be applied to the column, said different pairs of voltages being a strictly increasing series of $(2^n+1)$ voltages where n is an integer >1, these voltages being distributed in $N=2^n$ pairs of consecutive voltages, each pair usable to display a range of grey levels, subdividing, at the screen controller, the binary words into two sub-words, one with n bits corresponding to high order bits and other with q-n bits corresponding to low order bits, where (q-n) is an integer, controlling, at a combinational logic stage in the column driving voltage, a set of switches that select a pair of voltages output by the discrete voltage generator from the n high order bits of a binary word and a signal output by a counter initialised at each line selection time, switching, at the combinational logic stage, from one of the voltages in the pair of voltages selected by the combinational logic stage to the other when the counter has reached a value corresponding to the q-n low order bits of the binary word, receiving, at the counter, a set of non-linearly distributed pulses, corresponding to the pair of voltages, output from a pulse generator connected to the screen controller through a multiplexer, and receiving, at the multiplexer, the n high order bits of the binary word output by the numeric data source as an address.

* * * * *